US007546049B2

(12) United States Patent
Ehara et al.

(10) Patent No.: US 7,546,049 B2
(45) Date of Patent: Jun. 9, 2009

(54) IMAGE FORMING DEVICE WITH A CONTROL MEANS TO CORRECT THE FIXING CONTROL TEMPERATURE

(75) Inventors: Masanao Ehara, Saitama (JP); Ippei Fujimoto, Kawasaki (JP); Shinichi Namekata, Yokohama (JP); Hiroshi Yoshinaga, Ichikawa (JP); Hirofumi Ogawa, Kawasaki (JP); Tadashi Ogawa, Kawasaki (JP); Hiroyuki Shimada, Tokyo (JP)

(73) Assignee: Ricoh, Ltd., Tokyo (JP)

( * ) Notice: Subject to any disclaimer, the term of this patent is extended or adjusted under 35 U.S.C. 154(b) by 189 days.

(21) Appl. No.: 11/335,620

(22) Filed: Jan. 20, 2006

(65) Prior Publication Data

US 2006/0177232 A1 Aug. 10, 2006

(30) Foreign Application Priority Data

Jan. 21, 2005 (JP) ..... 2005-013777
Jan. 25, 2005 (JP) ..... 2005-016338
Jan. 25, 2005 (JP) ..... 2005-017546

(51) Int. Cl.
*G03G 15/20* (2006.01)
*G03G 15/00* (2006.01)

(52) U.S. Cl. ..... 399/69; 399/44

(58) Field of Classification Search ..... 399/44, 399/67, 69, 94; 347/156; 219/216; 430/124.1, 430/124.3

See application file for complete search history.

(56) References Cited

U.S. PATENT DOCUMENTS 5,581,341 A * 12/1996 Tanaka ..... 399/69
5,832,354 A 11/1998 Kouno et al. ..... 399/330
5,895,152 A * 4/1999 Ide et al. ..... 219/216 X
5,915,147 A 6/1999 Kouno et al. ..... 399/69
6,219,520 B1 4/2001 Ehara et al. ..... 399/325
6,389,247 B1 * 5/2002 Chung ..... 399/69
6,628,916 B2 9/2003 Yasui et al. ..... 399/329
6,636,709 B2 10/2003 Furukawa et al. ..... 399/69
6,778,790 B2 8/2004 Yoshinaga et al. ..... 399/69
6,778,804 B2 8/2004 Yoshinaga et al. ..... 399/325
6,785,505 B2 8/2004 Yasui et al. ..... 399/329
6,807,386 B2 * 10/2004 Yasui et al. ..... 399/69
6,881,927 B2 4/2005 Yoshinaga et al. ..... 219/216
6,892,044 B2 5/2005 Yasui et al. ..... 399/324

(Continued)

FOREIGN PATENT DOCUMENTS

JP 02-217876 A * 8/1990

(Continued)

*Primary Examiner*—Sophia S Chen
(74) *Attorney, Agent, or Firm*—Harness Dickey & Pierce

(57) ABSTRACT

An image forming device whereby stable fixing performance is obtained and whose fixing properties are excellent and that does not produce curling of the paper after fixing, due to performing control for correcting fixing temperature by environmental sensing not only during standby but also over time. A plurality of temperature detecting units are provided in the fixing device and a plurality of detecting units that detect temperature and humidity are provided within the image forming device. Temperature correction is performed whereby the target control temperature of the fixing device is changed to a prescribed value in accordance with the temperature or humidity detected by the plurality of detecting units.

19 Claims, 16 Drawing Sheets

U.S. PATENT DOCUMENTS

2003/0002881 A1* 1/2003 Hirose et al. ..... 399/44
2004/0258425 A1* 12/2004 Phillips ..... 399/67
2005/0025539 A1 2/2005 Yoshinaga ..... 399/329
2005/0095043 A1 5/2005 Yoshinaga et al. ..... 399/329
2005/0163524 A1* 7/2005 Shiobara et al. ..... 399/69
2006/0051113 A1* 3/2006 Kishi et al. ..... 399/44

FOREIGN PATENT DOCUMENTS

JP 10-039672 2/1998
JP 2000-315034 A * 11/2000
JP 2003-014558 A * 1/2003

* cited by examiner

FIG. 10

| | LEF | SEF | AREA |
|---|---|---|---|
| A4 | 297mm | 210mm | 62370mm$^2$ |
| LT | 279mm | 216mm | 60264mm$^2$ |

FIG. 11

| PAPER SIZE | $5 \leqq \Delta T < 10$ | $10 \leqq \Delta T$ |
|---|---|---|
| NORMAL | 5deg | 10deg |
| SMALL (*)<br>A4, B5, A5, B6 | 7deg | 15deg |

FIG. 12

| | 0 | 1 | 2 |
|---|---|---|---|
| CORRECTION OVER TIME | NONE | FU ON ONE FACE ;<br>FD ON ONE FACE ;<br>EXCEPT FOR PAPER DISCHARGE | APPLIED IN ALL CASES |

IMAGE FORMING DEVICE WITH A CONTROL MEANS TO CORRECT THE FIXING CONTROL TEMPERATURE

BACKGROUND OF THE INVENTION

1. Field of the Invention

The present invention relates to an image forming device of the electrophotographic type such as a copier, facsimile machine, printer or printing machine, and a control method therefor, and particularly relates to a fixing device and a control method therefor in which fixing properties are stable and curl is not produced in the transfer paper after fixing, by performing temperature correction control of fixing of the toner image on the transfer paper constituting a sheet-like recording medium, using pressure or heat.

2. Description of the Related Art

Image forming device of this type have become very common in recent years. In particular, improvements in for example image quality, energy saving, and convenience are continually being demanded. Of these, since the energy consumption of the fixing device that is mounted in the image forming device represents 50% or more, efforts are being made to improve energy saving of the fixing device. Efforts are therefore being made to shorten the starting up time or recovery time by reducing the thickness and decreasing the amount of heat used by the fixing members constituting the fixing device.

As a fixing device, a construction of the fixing roller type is known, in which a pair of rollers are arranged facing each other, one of the rollers being used as a heating roller while the other roller is used as a pressurizing roller for applying pressure to the sheet-like recording medium, such as transfer paper. In this construction, fixing is effected by melt bonding of the unfixed image by heat from the heating roller, while the recording medium is fed while being gripped in the nip between the heating roller and pressurizing roller.

Apart from this fixing roller type construction, a fixing belt type construction is also known, comprising an assembly of rollers and a belt. In this construction, instead of the heating roller, a belt is employed that is passed over a pair of rollers, with a pressurizing roller being arranged facing one of these rollers. Of this pair of rollers, a heat source is provided for heating from the inside face of the belt at the roller that drives the belt in co-operation with the roller on the side facing the pressurizing roller, and a heat source is also provided at the pressurizing roller for heating the outside face of the belt. The belt is of smaller volume than the rollers and its heat capacity is small, so it can be raised in temperature in a short time, so the advantage is obtained that initial elevation of temperature at start-up can be achieved more rapidly than in the case of a construction using only a heating roller and pressurizing roller as described above. Furthermore, elevation of temperature at both the outside and inside of the belt is speeded up by providing a heat source at the pressurizing roller. It should also be noted that a double layer construction is known, in which, when aluminum, which is of high thermal conductivity, is used to construct the rollers in the case of a belt construction, in the case where stainless-steel is employed as the substrate that effects contact at the outer surface of the rollers, a belt body comprising a releasing layer made of silicone rubber or fluorine-based resin is arranged at the outer surface thereof.

However, as described above, although, with the conventional fixing device, rapid start-up can be achieved, since it is possible to rapidly heat specified portions of the fixing member by reducing the or heat capacity of the fixing member, when the entire fixing device or the entire image forming device becomes warmed up, in the case of several printing cycles or where the time for which the printing action is repeated is prolonged (hereinbelow this will simply referred to as "over time"), the amount of heat that is applied to the toner or transfer paper becomes excessive, so problems arise in that abnormal images, poor feeding or poor stacking due to curling of the transfer paper tend to occur. For this reason, consideration has been given to predicting the temperature increase over time and setting the target control temperature of the fixing device lower from the initial period. However this leads to problems of generation of abnormal images due to insufficient heating in the initial period on starting up or after recovery of operation of the fixing device.

Furthermore, in addition to the above problems, the transfer paper constituting the recording medium prior to transfer is not at a fixed temperature but is affected by the storage environment. Consequently, the amount of heat that is required when introducing the transfer paper to the fixing device after transfer may change, depending on the storage environment temperature of the transfer paper prior to transfer. In addition to temperature control within the fixing device, the fixing temperature must therefore be controlled using a plurality of detection means that detect the temperature and humidity of the external air wherein the image forming device is held and the temperature and humidity within the image forming device.

As prior art relating to control of fixing temperature, an image forming device as disclosed in Laid-open Japanese Patent Application No. H. 10-39672 is known. In this image forming device, a temperature sensor is arranged in a position where it is unlikely to be affected by the heat generated by the fixing device in the device interior, but the internal temperature of the image forming device changes depending on the job, so the environmental temperature cannot be precisely detected. Consequently, the value of this sensor is not used after job commencement; rather, the fixing temperature is corrected in accordance with environmental temperature detection during standby. It should be noted that this publication does not disclose the specific location of the sensor.

Furthermore, Laid-open Japanese Patent Application No. 2004-212968 discloses an image forming device wherein elevation of the temperature within the image forming device is suppressed by the provision of temperature detection means that detects the temperature of the fixing belt and a control unit that performs control of the image forming processing in accordance with the detected temperature. In addition, Japanese Patent No. 3425040 discloses an image forming device that provides excellent fixing properties by preventing the existence of a large difference between the standby control temperature and operating control temperature, even where fluctuation of the environmental temperature during standby has taken place, by correcting the fixing control temperature during standby, in accordance with the environmental temperature.

However, in these items of prior art, fixing temperature correction in accordance with environment detection is not performed over time. Consequently, even in cases where the temperature of the transfer paper after transfer is not affected by the storage environment, since the periphery of the fixing device and the feed path rise in temperature over time, when the transfer paper enters the fixing device, the amount of heat applied to the transfer paper after transfer becomes excessive, leading to problems of curling of the transfer paper after fixing. When the paper curls, alignment of the paper on discharging is lost, giving rise to problems of the transfer paper escaping from the binding by the finisher or being displaced in this binding.

SUMMARY OF THE INVENTION

An object of the present invention is to provide an image forming device and control method therefor comprising a fixing device of excellent toner fixing properties and that does not generate transfer paper curling after printing.

A further object of the present invention is to provide an image forming device and control method therefor comprising a fixing device of excellent fixing properties and that does not generate curling of the paper after fixing and wherein stable fixing properties are obtained, by exercising control that effects correction of fixing temperature by environmental sensing over time, in addition to during standby.

In accordance with an aspect of the present invention, an image forming device comprises a fixing device that fixes a transfer member that carries a toner image that is not yet fixed; a temperature detection device that detects the temperature within the image forming device in which this fixing device is provided; and a control device that corrects the control temperature of the fixing device in accordance with the detection result of this temperature detection device. The temperature detection device is arranged in the vicinity of the fixing device.

In accordance with another aspect of the present invention, an image forming device comprises a fixing device that performs fixing by heating a transfer member that carries a toner image that is not yet fixed; a temperature detection device that detects the temperature within the image forming device in which this fixing device is provided; and a control device that corrects the control temperature of the fixing device in accordance with the detection result of this temperature detection device. The temperature detection device detects the temperature of a cover of the fixing device.

In accordance with another aspect of the present invention, an image forming device comprises a fixing device that performs fixing by heating a transfer member that carries a toner image that is not yet fixed; a temperature detection device that detects the temperature within the image forming device in which this fixing device is provided; and a control device that corrects the control temperature of the fixing device in accordance with the detection result of this temperature detection device. The temperature detection device detects the temperature of a feed guide plate arranged between a transfer nip and a fixing nip.

In accordance with another aspect of the present invention, an image forming device comprises a fixing device that performs fixing by heating a transfer member that carries a toner image that is not yet fixed; a temperature detection device that detects the temperature within the image forming device in which this fixing device is provided; and a control device that corrects the control temperature of the fixing device in accordance with the detection result of this temperature detection device. The temperature detection device detects the temperature of a transfer belt.

In accordance with another aspect of the present invention, in an image forming device, an image that is not yet fixed formed on a recording medium is fixed by application of heat and pressure by passing the image through a fixing nip formed by at least two or more fixing members, and-at least one of the fixing members can be controlled to a target temperature. A first temperature detection device is provided in a position that is greatly affected by heat when fixing is performed, and a second temperature detection device is provided in a position that is less affected by heat when fixing is performed, on the paper feed path upstream of the fixing nip. The fixing target temperature is changed in accordance with the result of comparison of these first and second devices. The amount of the temperature change is altered in accordance with the size of the recording medium that carries this image that has not yet been fixed.

In accordance with another aspect of the present invention, a method of control for an image forming device fixes an image that is not yet fixed formed on a recording medium by application of heat and pressure by passing the image through a fixing nip formed by at least two or more fixing members. At least one of the fixing members is controlled to a target temperature. A first temperature detection device is provided in a position that is greatly affected by heat when fixing is performed. A second temperature detection device is provided in a position that is less affected by heat when fixing is performed, on the paper feed path upstream of the fixing nip. The fixing target temperature is changed in accordance with the result of comparison of these first and second devices. The amount of the temperature change is altered in accordance with the size of the recording medium that carries this image that has not yet been fixed.

In accordance with another aspect of the present invention, an image forming device comprises a fixing device that fixes toner on a recording medium; a temperature detection device comprising first temperature detection device provided at a position that is greatly affected by heat when fixing is performed, and second temperature detection device provided at a position that is less affected by heat when fixing is performed; a control device that performs temperature correction wherein the target control temperature of the fixing device is changed to a prescribed value in accordance with the first and second temperature detection device; and a detection device that detects temperature and/or humidity of an outside air in which the image forming device is held, and temperature and/or humidity of a prescribed position within the image forming device. The target control temperature of a fixing device is corrected in accordance with the temperature and humidity detected by the detection device of the image forming device and the temperature detected by temperature detection device of the fixing device.

BRIEF DESCRIPTION OF THE DRAWINGS

The above and other objects, features and advantages of the present invention will become more apparent from the following detailed description taken with the accompanying drawings in which:

FIGS. 10 and 11 are tables showing the relationship between the amount of correction and paper size;

FIG. 12 is a table showing the relationship between amount of correction and paper discharge destination;

DESCRIPTION OF THE PREFERRED EMBODIMENTS

Embodiments of the present invention are described in detail below.

It should be noted that, although the image forming device comprising a fixing device according to the various embodiments of the present invention is applied as a copier, printer, or facsimile machine wherein a full-color image is formed by a tandem arrangement of four linked devices, it could of course also be applied to a device in which a monochromatic image is formed.

First Embodiment

Figure 1:
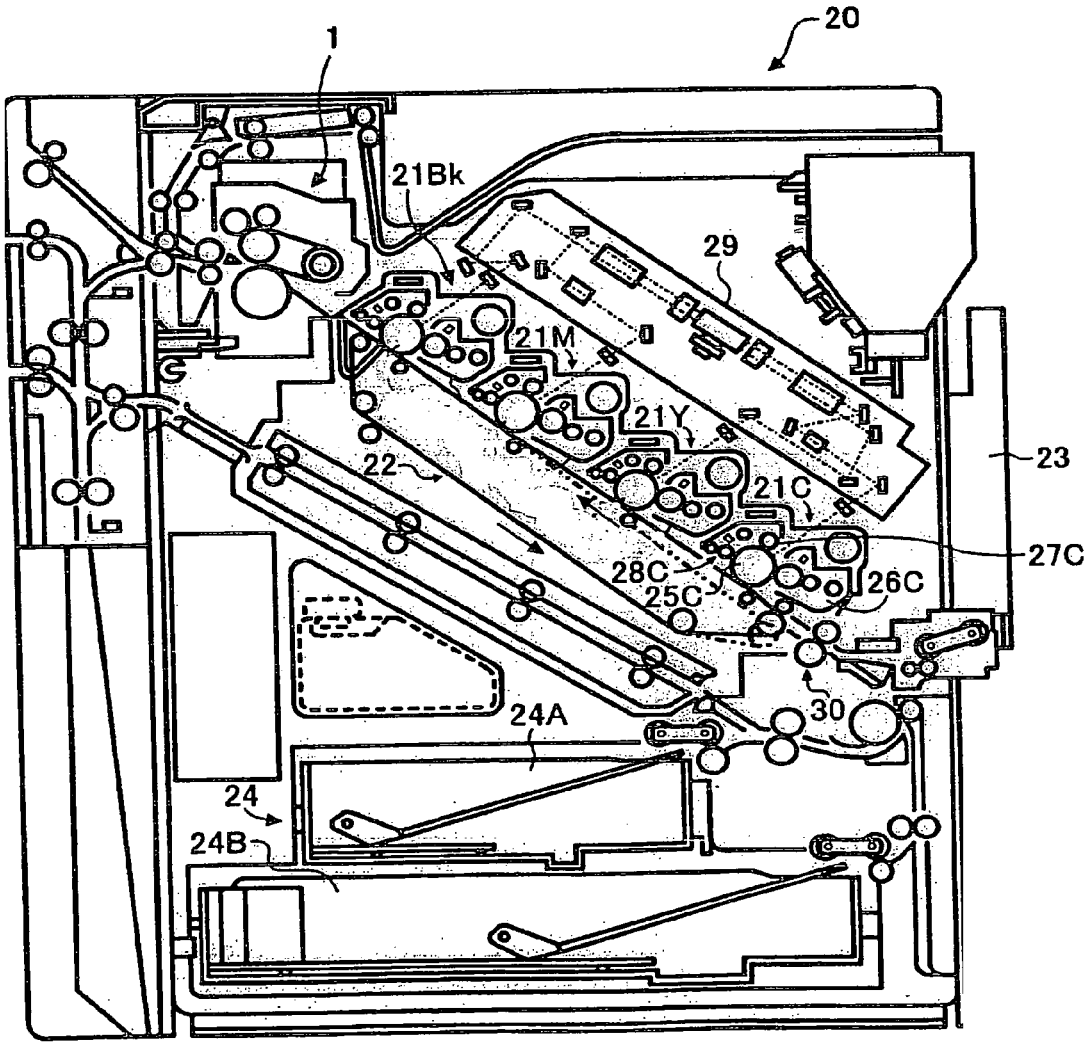
FIG. 1 is a view showing the construction of an image forming device comprising a fixing device according to a first embodiment of the present invention.

FIG. 1 shows the construction of an image forming device according to this embodiment. In the case of this image forming device, a system is adopted wherein a color image is directly formed on a sheet-like recording medium from a latent image carrier by superimposed transfer of respective images produced by color resolution onto the sheet-like recording medium, the sheet-like recording medium being attached to a transfer belt employed as a transfer body.

As can be seen from this Figure, this image forming device 20 comprises: image creation devices 21Y, 21M, 21C, 21BK, that form images of each respective color in accordance with the original image; a transfer device 22 arranged facing these image creation devices 21Y, 21M, 21C, 21BK; a hand-feed tray 23 constituting sheet supply means that supplies sheet-like recording media to the transfer zone facing the image creation devices 21Y, 21M, 21C, 21BK and the transfer device 22; a first paper feed cassette 24A and a second paper feed cassette 24B installed in a paper feed device 24; a register roller 30 that feeds the sheet-like recording media that are fed in from this hand-feed tray 23 and paper supply cassettes 24A, 24B, with a timing matching the image creation timing of the image creation devices 21Y, 21M, 21C, 21BK; and a fixing device 1 that performs fixing of the image on the sheet-like recording medium after transfer in the transfer zone.

This image forming device 20 can employ as sheet-like recording medium any of ordinary paper that is generally employed in copiers, for example, or so-called special sheets (hereinbelow simply referred to as special sheets) of larger thermal capacity than printing paper such as OHP sheets, 90 K paper i.e. postcards, thick paper corresponding to an average weight of about 100 g/m$^2$ or more, or envelopes.

The image creation devices 21C, 21Y, 21M, 21BK perform development of the respective colors: cyan, yellow, magenta and black and employ toner of different colors; however, their construction is the same, so the construction of the image creation device 21C will be described as a typical example of these image creation devices 21C, 21Y, 21M, 21BK. For the image creation device 21C, a device of a known construction is employed, comprising an electrostatic latent image carrier constituted by a photosensitive body drum 25C, a charging device 27C, developing device 26C and cleaning device 28C that are arranged in order along the direction of rotation in the clockwise direction in the drawing i.e. the direction of rotation of the photosensitive body drum 25C; in this device exposure light is received from a writing device 29 arranged between the charging device 27C and developing device 26C. The electrostatic latent image carrier may be in the form of a drum or may be in the form of a belt.

Figure 2:
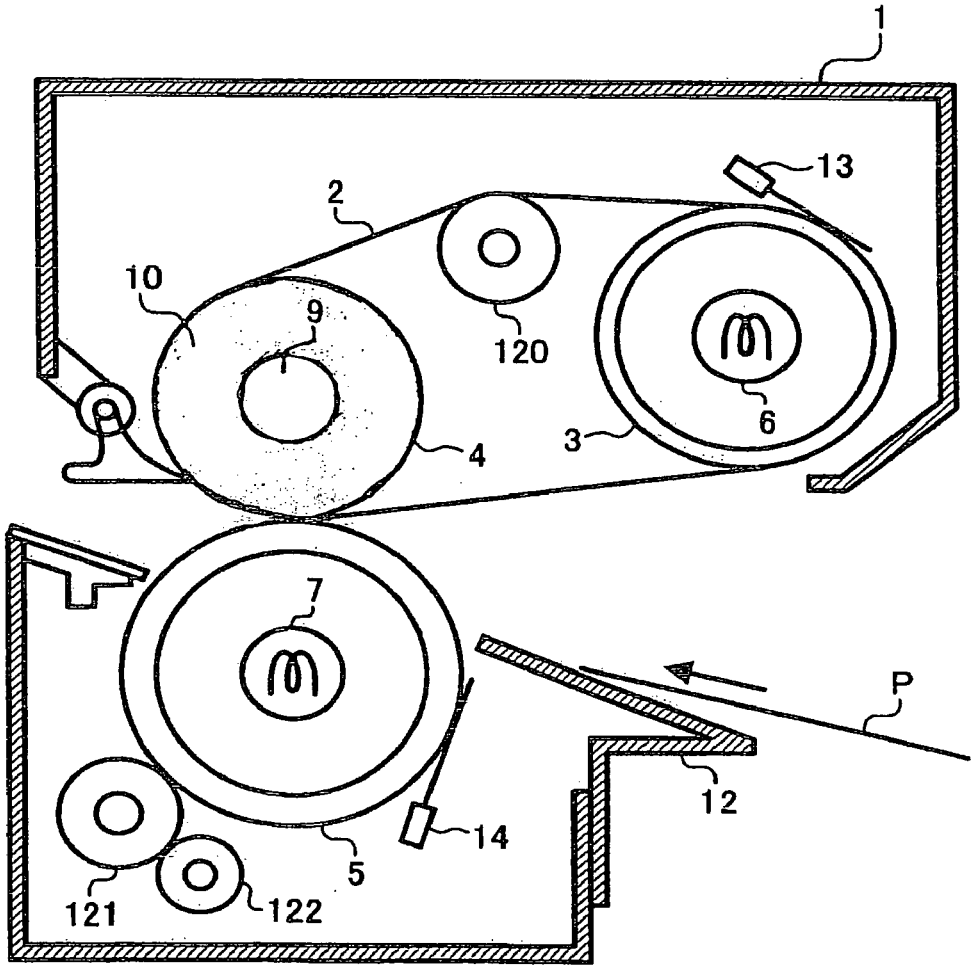
FIG. 2 is a view showing the construction of a fixing device according to the first embodiment of the present invention.

FIG. 2 shows the construction of a fixing device according to this embodiment. As shown in this Figure, the fixing device 1 respectively comprises: a fixing belt 2 of endless shape for feeding sheet-like recording media on which toner is to be fixed; a heating roller 3 and fixing roller 4 on which the fixing belt 2 is stretched; a pressurizing roller 5 arranged facing the fixing roller 4 with the fixing belt 2 therebetween; heaters 6, 7 provided within the heating roller 3 and pressurizing roller 5; and a belt side thermistor 13 and pressurizing side thermistor 14 constituting temperature detection means that detect respective temperatures arranged facing the fixing belt 2 and pressurizing roller 5. A suitable prescribed tension is applied to the fixing belt 2 by biasing a tension roller 120 from the inside of the fixing belt 2 by means of an elastic body, not shown, such as a spring.

The fixing roller 4 comprises a metal core 9 and an elastic body layer 10 of a heat-resistant porous layer that covers this metal core 9. The fixing roller 4 is biased into pressure contact with the pressurizing roller 5 by an elastic body, not shown, such as spring. The reference symbol 12 indicates a guide whereby the transfer paper P that is to be fixed is guided towards the first fixing unit.

A roller 121 for applying a minute amount of oil is brought into contact with the pressurizing roller 5 by means of an elastic body, not shown, such as a spring, so that a minute amount of silicone oil is applied to the surface of the fixing belt 2 and pressurizing roller 5, with the object of improving release of the fixing belt 2 and toner. Also, a cleaning roller 122 is brought into contact with the surface of the roller 121 for applying a minute amount of oil, with the object of preventing sticking of toner to the surface of the roller 121 for applying a minute amount of oil.

Figure 3:
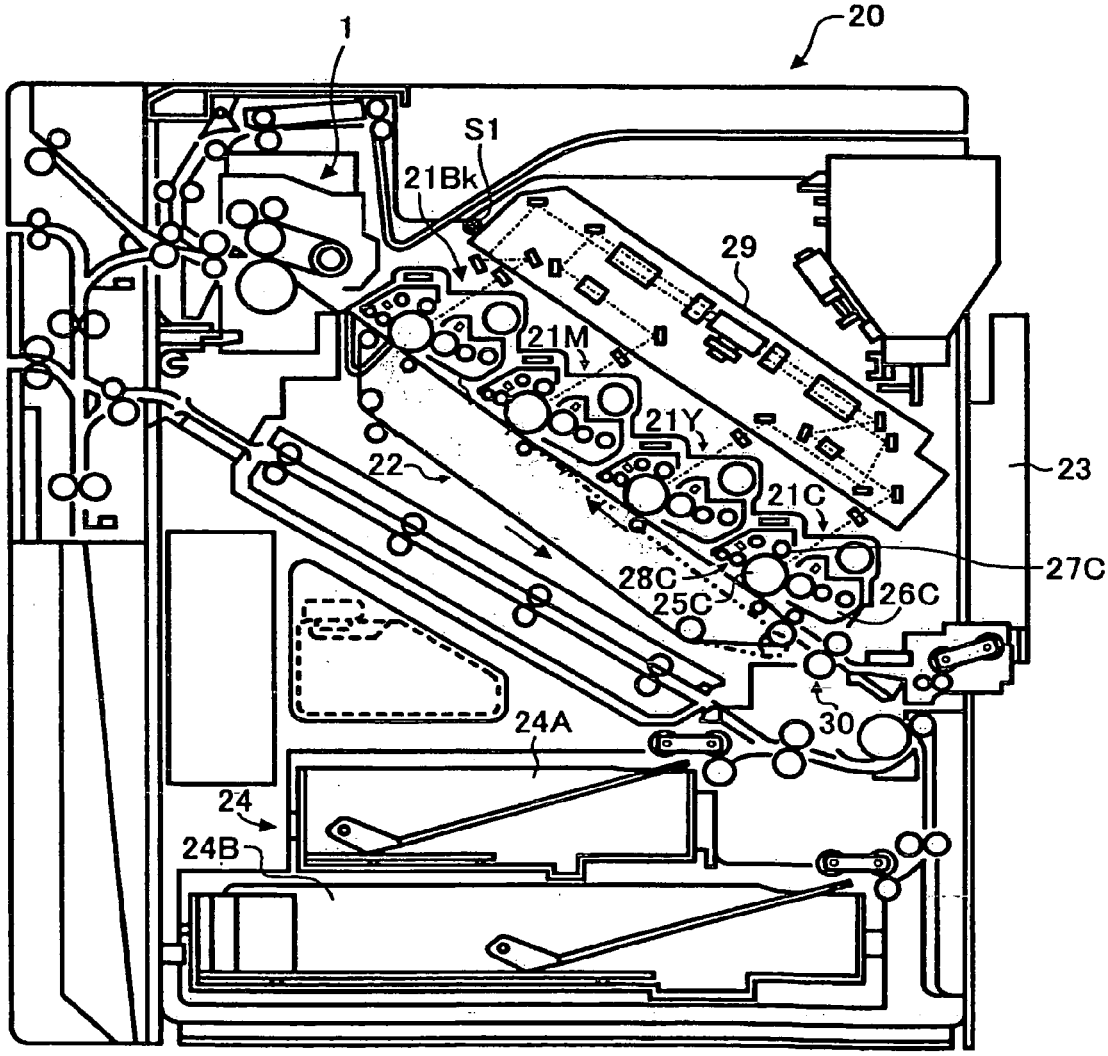
FIG. 3 is a view showing the positions of temperature sensors in practical example 1 of this embodiment.

FIG. 3 shows the positions of the temperature sensors in practical example 1 of this embodiment. As shown in this Figure, in this practical example 1, a temperature sensor S1 is provided on the frame of the writing device 29, to detect the temperature of the frame of the writing device. Correction of the fixing temperature is performed using the temperature detected by this temperature sensor S1. The temperature detection may be detection of the temperature of an object or of the atmosphere.

Figure 4:
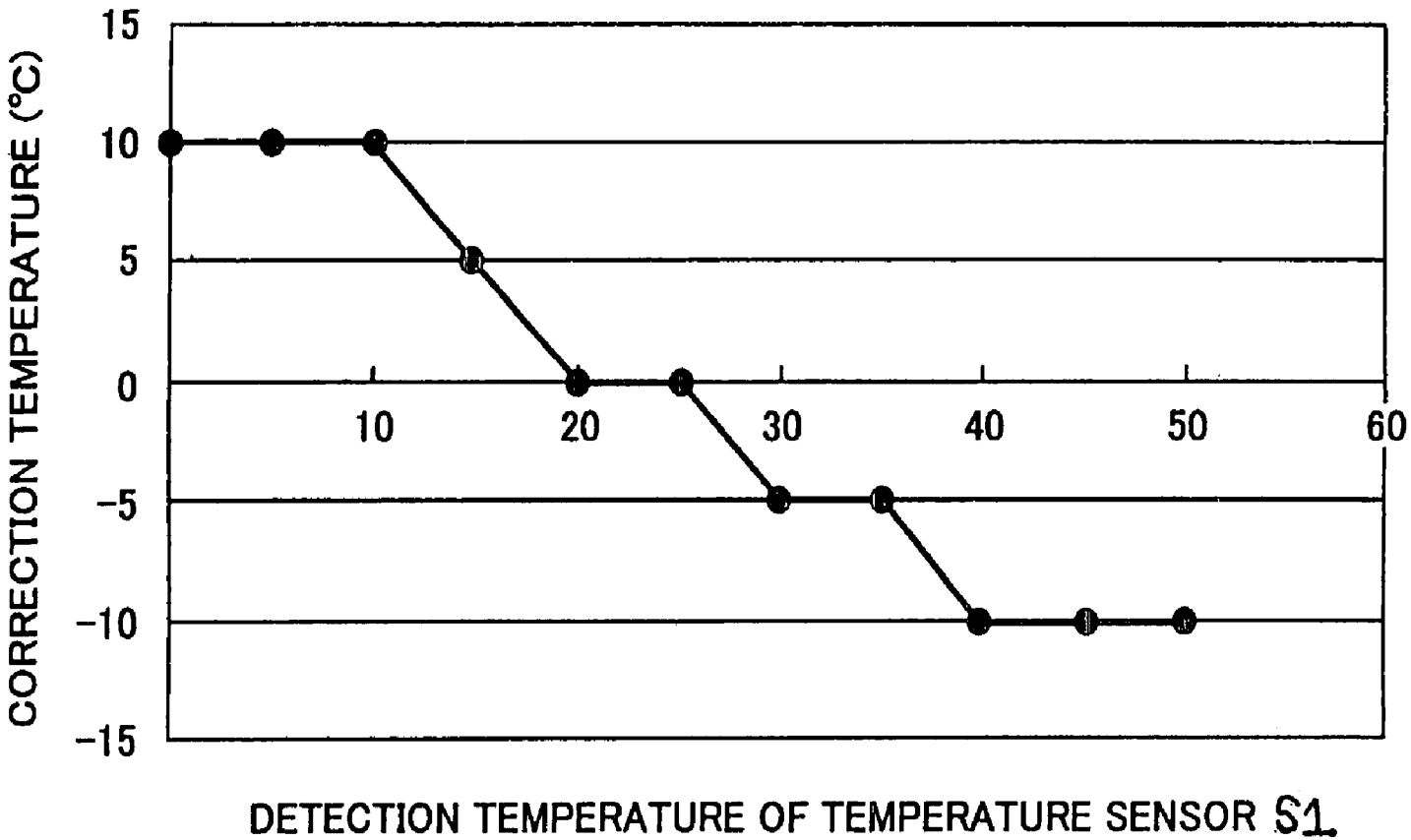
FIG. 4 is a view showing the relationship between the detection temperature of the temperature sensor and the correction temperature in practical example 1 of this embodiment.

FIG. 4 is a view showing the relationship between the detection temperature of the temperature sensor and the correction temperature. As shown in this Figure, the fixing temperature is increased or decreased in accordance with the temperature that is thus selected, the correction value being different depending on the detected temperature. In this practical example 1, the position of the temperature sensor S1 is roughly 150 mm from the main heat source (corresponding to the heating roller 3 shown in FIG. 2 in the case of this practical example 1) of the fixing device 1, but it merely needs to be within about 200 mm from the fixing device. Also, although the temperature detection sensor S1 serves to detect the temperature of a device that is heated by the heat generated by the fixing device 1, since its object is to detect (predict) indirectly the temperature of the transfer paper entering the fixing device 1, it is preferably positioned between the transfer device 22 and fixing device 1, or in the neighborhood thereof or, as in the case of this practical example 1, may be in the position shown in FIG. 3, in consideration of the effects of for example air flow and thermal conduction within the device.

Figure 5:
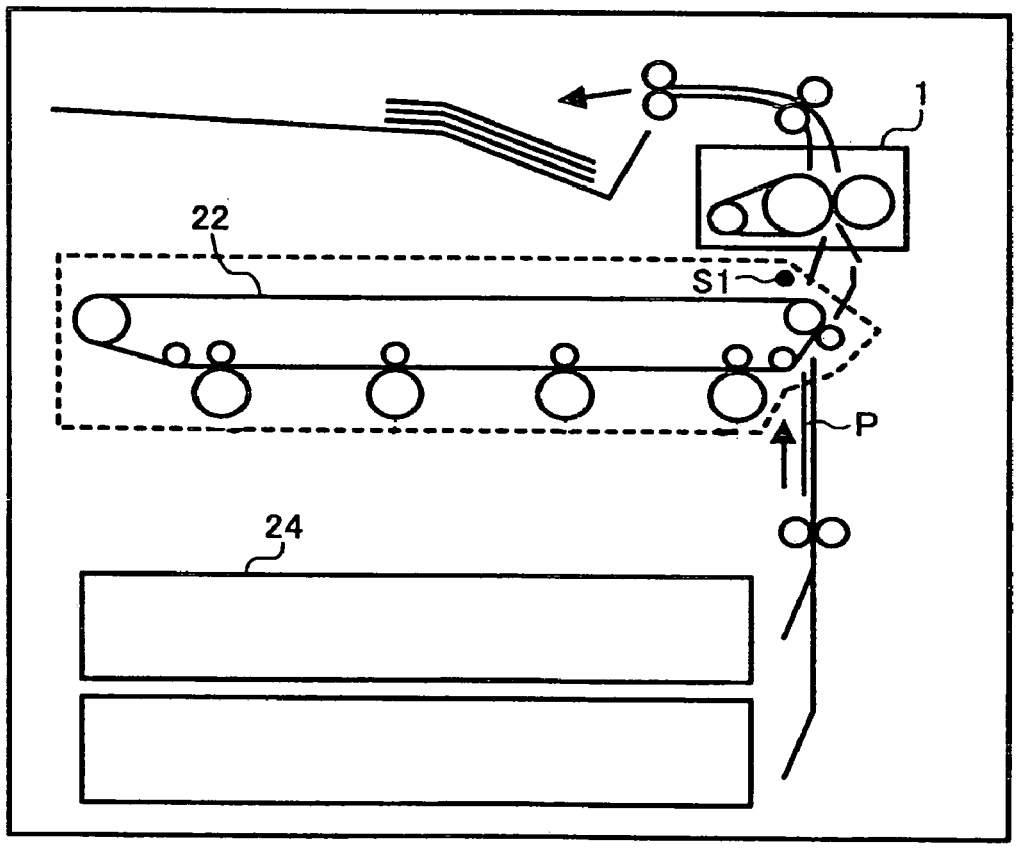
FIG. 5 shows the position of the temperature sensor in practical example 2 of this embodiment.

FIG. 5 shows the position of the temperature sensor in practical example 2 of this embodiment. As shown in the Figure, the position of the temperature sensor S1 of an image forming device wherein the feed path of the transfer paper P is different from that of practical example 1 is shown. Specifically, in this practical example 2, the temperature sensor S1 is arranged on the device housing (casing), not shown. In this practical example 2, just as in the case of practical example 1 described above, the temperature sensor S1 is arranged between the transfer device 22 and fixing device 1.

Figure 6:
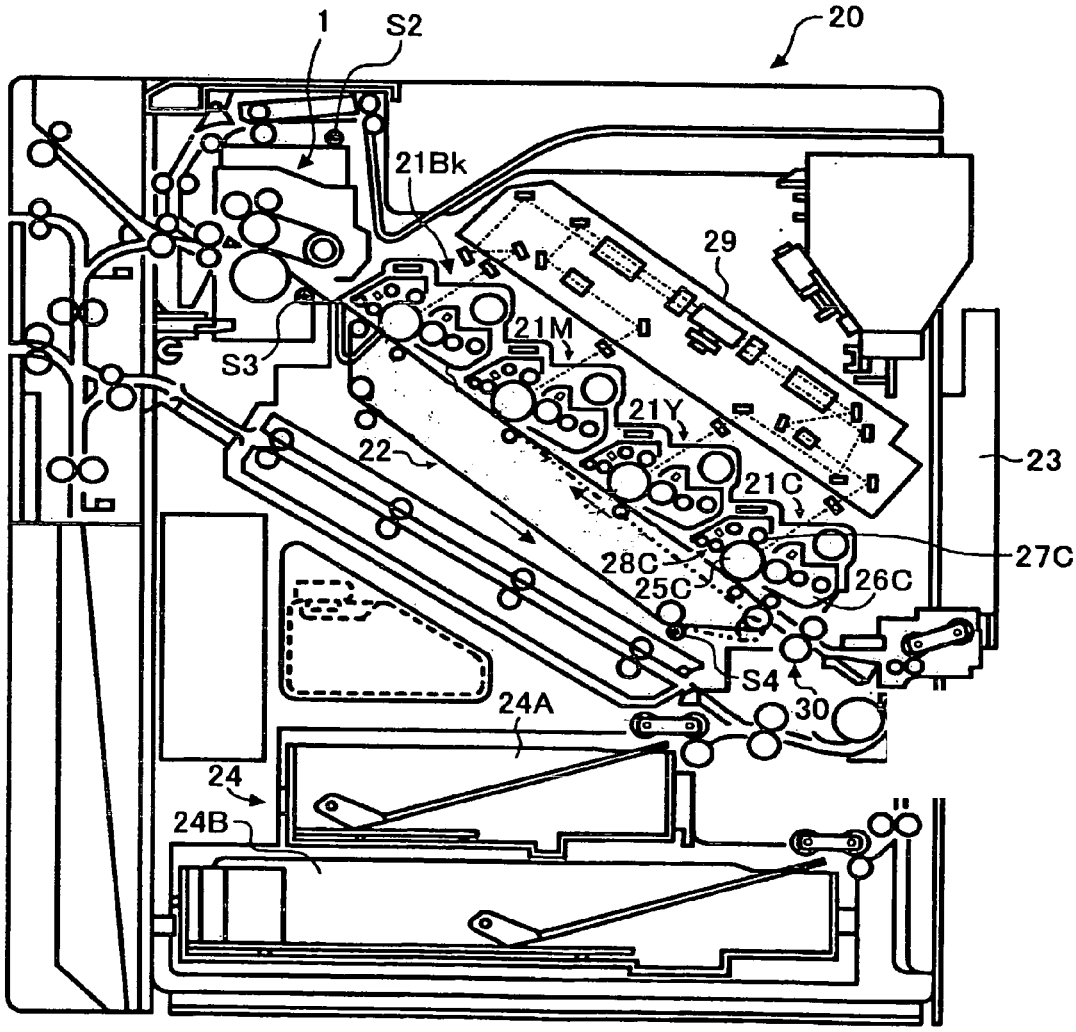
FIG. 6 is a view showing the arrangement of the temperature sensor in practical examples 3 to 5 of this embodiment.
Figure 7:
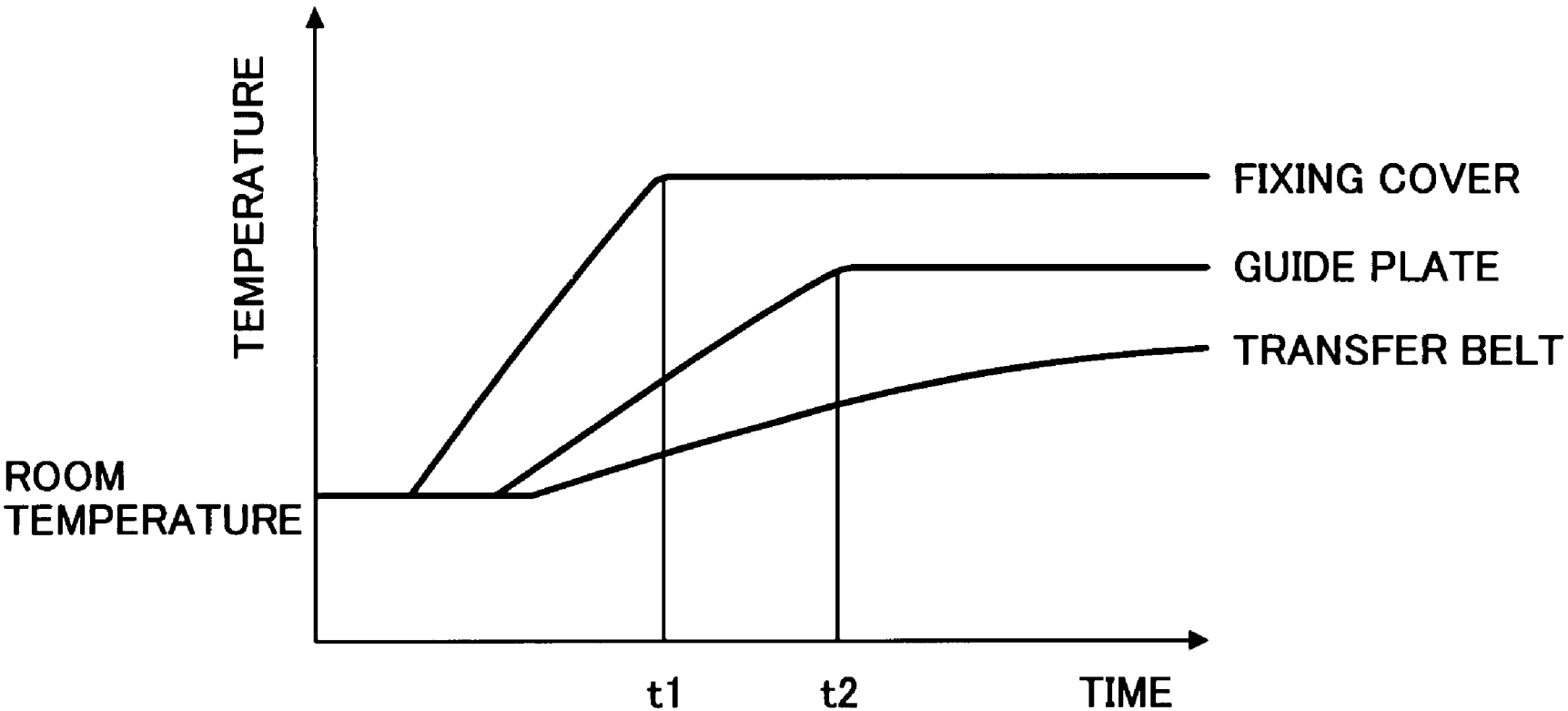
FIG. 7 is a view showing the temperature curve in practical example 3.

FIG. 6 is a view showing the arrangement of the temperature sensor in practical examples 3 to 5 of this embodiment. FIG. 7 is a view showing the temperature curve in practical example 3. In this practical example 3, a temperature sensor S2 constituting temperature detection means is arranged above the fixing cover. Since the fixing cover is particularly susceptible to the effect of temperature in the fixing device, it is suitable for performing correction of the fixing temperature at a comparatively early stage (by the time t1 shown in FIG. 7) after commencement of operation of the device. This is appropriate in the case of for example thin paper, which is sensitive to temperature.

As shown in FIG. 6, in the case of practical example 4, a temperature sensor S3 constituting temperature detection means is arranged on a fixing inlet guide plate. The fixing inlet guide plate rises in temperature more slowly than the fixing cover, so this is appropriate in cases where temperature correction is performed after a comparatively long time (by the time t2 shown in FIG. 7) after commencement of operation of the device. This can be applied to the transfer paper as whole.

As shown in FIG. 6, in practical example 5, a temperature sensor S4 constituting temperature detection means is arranged at the surface of the transfer paper. The transfer belt does not reach as high a temperature as the guide plate since feeding takes place while it is tightly in contact with the transfer paper for a comparatively long time, but its effect on the transfer paper is considerable. It is therefore appropriate in the case where correction is applied for example during a long period of continuous printing.

It should be noted that, as practical example 6, it would also be possible to combine any two of the practical examples 1 to 5 described above. In this way, temperature correction can be performed with high accuracy over time from the initial period.

Furthermore, while it is known that a characteristic feature of a fixing device 1 using an endless belt is that it provides effective means for example for shortening the warm-up time or decreasing the energy consumption, the present embodiment provides temperature correction for eliminating the problem caused by excessive amount of heat, such as curling, and, at the same time, as shown in FIG. 7, achieves optimization of the amount of heat in that it performs correction to raise the temperature when the amount of heat is tending to be insufficient (for example in the case where the temperature is 25° C. or less) and performs correction to lower the temperature when the amount of heat is tending to be excessive (for example when the temperature is 35° C. or more): thus its effect is exhibited in the case of fixing means such as a belt whose heat capacity is small compared with a roller, in other words fixing means which easily tend to heat up or cool down.

As described above, according to this first embodiment, there can be provided an image forming device and a method of control therefor, comprising a fixing device providing excellent toner fixing and in which curling of the transfer paper after printing does not occur.

Second Embodiment

Figure 8:
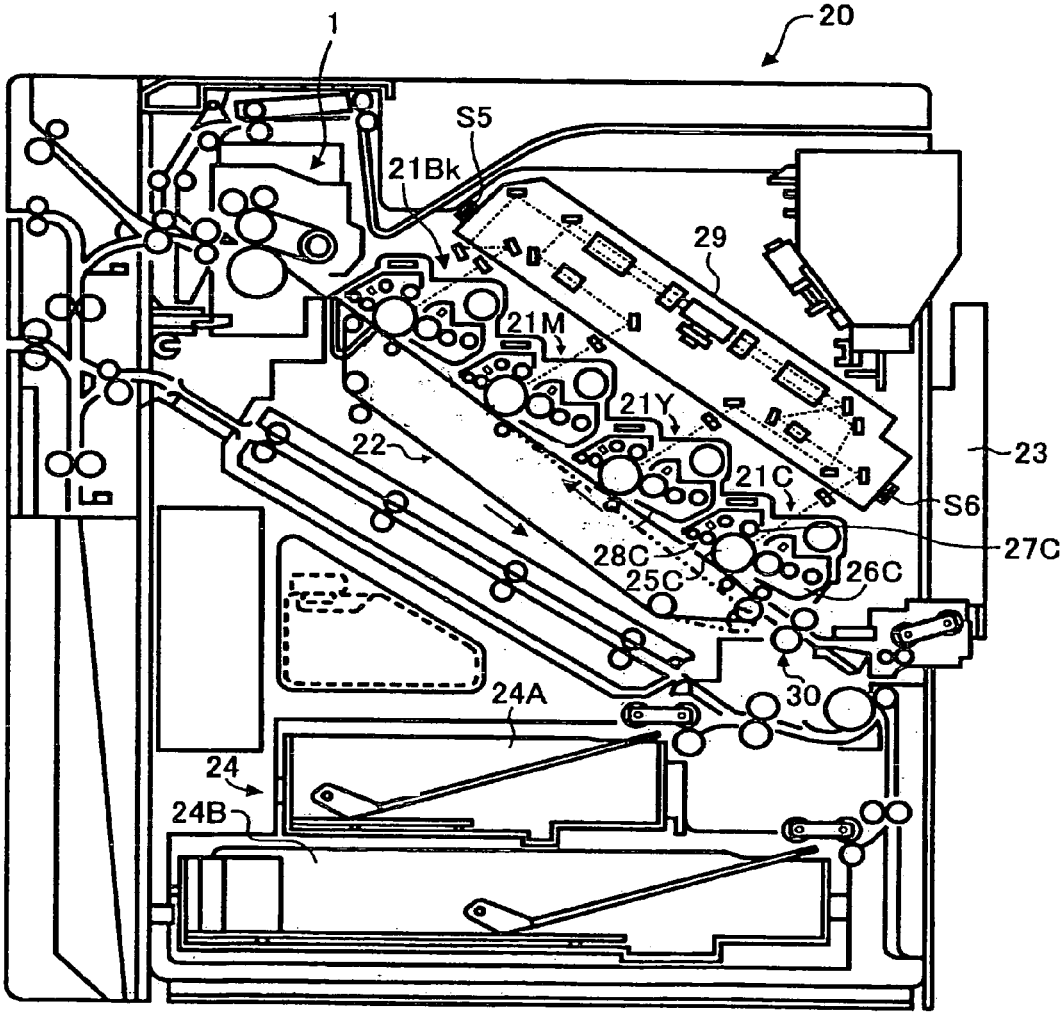
FIG. 8 is a view showing the construction of an image forming device comprising a fixing device according to a second embodiment of the present invention.

The construction of an image forming device according to this embodiment is shown in FIG. 8. However, since this is substantially the same as the construction of an image forming device according to the first embodiment shown in FIG. 1, repeated description is dispensed with and only the points of difference are described. Also, the fixing device according to this embodiment is exactly the same as the fixing device 1 of the first embodiment described above illustrated in FIG. 2, so repeated description is dispensed with.

As shown in FIG. 8, a characteristic feature of this embodiment is that temperature sensors S5 and S6 are provided on the writing device 29.

An example of temperature correction control according to this embodiment is described below in a case in which there is an incoming request for printing of monochromatic black. However, apart from this, in the case for example of full-color mode also, a decision is made in the same way as to whether or not to execute temperature correction, and control is performed with respectively corresponding temperature amounts. A description of the flow from delivery of a print request to the control unit up to the start of fixing is given with reference to the flowchart of FIG. 9.

When a print request is sent to the control unit, the output values T1, T2 of the temperature sensors SS, S6 at that point are acquired. Next, the difference ΔT of the temperatures T1, T2 that were previously acquired is acquired by $\Delta T = T1 - T2$. Next, the magnitude relationship of the temperature ΔT and a threshold value temperature, that may be arbitrarily set, (assumed in the case of this embodiment to be 5° C.) is compared. If $\Delta T < 5°$ C., it is concluded that temperature correction is unnecessary, since the interior of the image forming device is not heating up, and fixing is commenced with the target control temperature Tcont left at Tcont=170° C. If $\Delta T \geqq 5°$ C., next, T2 is first compared with the threshold value Th that is capable of being set to an arbitrary value. The correction amount in respect of the target control temperature is altered in accordance with the result of this comparison. If T2 is arranged on the outside air side of the image forming device, T2 can be considered as substantially equal to the outside air temperature. Consequently, if T2 is higher than Th (34° C. in the case of this embodiment), it is considered that the transfer paper must have been thoroughly warmed up, so the fixing temperature needs to be considerably lowered; but if T2 is lower than Th, it is concluded that there is no need to make much correction to the target control temperature.

Next, the magnitude relationship of the temperature of ΔT and the arbitrarily settable threshold temperature (assumed to be 10° C. in the case of this embodiment) is compared; if T2<Th and ΔT<10° C., temperature correction is performed with a correction amount Ta; if T2<Th and ΔT>10° C., temperature correction is performed with a correction amount Tb; if T2>Th and ΔT<10° C., temperature correction is performed with a correction amount Tc; and if T2>Th and ΔT>10° C., temperature correction is performed with a correction amount Td. For example, if T2<Th and ΔT<10° C., fixing is commenced after altering the target temperature control to (170° C.−Ta) ° C. This evaluation is repeated when a printing request is terminated or when the next printing request arrives. In this way, it is possible to set the optimum amount of heat for fixing taking into account the rise in temperature within the image forming device at the time point where the printing request arrives.

In practical example 1 of this embodiment, as shown in FIGS. 10 and 11, the correction amount Tx (where x is a, b, c or d) is altered for each paper size. In the case of small size, with a fixing device in which no edge heater is provided, a large temperature correction amount is applied, since curling is likely to occur due to rise in temperature of the edges in the axial direction. For paper size the paper area may be calculated, or the length in the feed direction, or the length in the feed direction and the length in the perpendicular direction may be taken as the paper size. More stable images can be produced by performing temperature correction in accordance with the size of the recording medium.

In practical example 2 of this embodiment, the correction amount is altered in accordance with the type of paper or paper thickness. In the case of paper thickness as great as 100 g/m$^2$, if fixing is performed with the same speed as in the case of ordinary paper in order to achieve the same productivity, the quantity of heat already tends to be insufficient; if this correction were to be performed, the margin in this respect would disappear. Thick paper does not easily curl, so it is beneficial not to apply this correction. More stable images can be provided by performing temperature correction in accordance with the type of paper and paper thickness of the recording medium.

In practical example 3 of this embodiment, the correction amount is altered in accordance with the paper source. For example, paper from the hand-feed tray conforms more closely to the environment than paper from the main tray and requires a different correction than in the case of the main tray: thus, at low temperature, no correction is made for paper from the hand-feed tray whereas a correction such as to effect a lowering in temperature of 5° C. may be applied in the case of paper from the main tray. More stable images can be provided by performing temperature correction in accordance with the paper source of the recording medium.

In practical example 4 of this embodiment, as shown in FIG. 12, the correction amount is altered in accordance with the paper discharge destination. In the case of paper discharge into the main body, some margin is available in regard to curling, so correction may be turned OFF in order to achieve maximum fixing performance; in the case of paper discharge to the finisher, this margin regarding curling is absent, so a large correction amount may be applied. The path and the distance through which the recording medium is fed differ depending on the discharge destination, so the amount of heat received from the image forming device, and other effects (stress), change: more stable images can therefore be provided by performing temperature correction in accordance with the discharge destination.

Exceptions in respect of the temperature correction of this embodiment will now be described.

Figure 13:
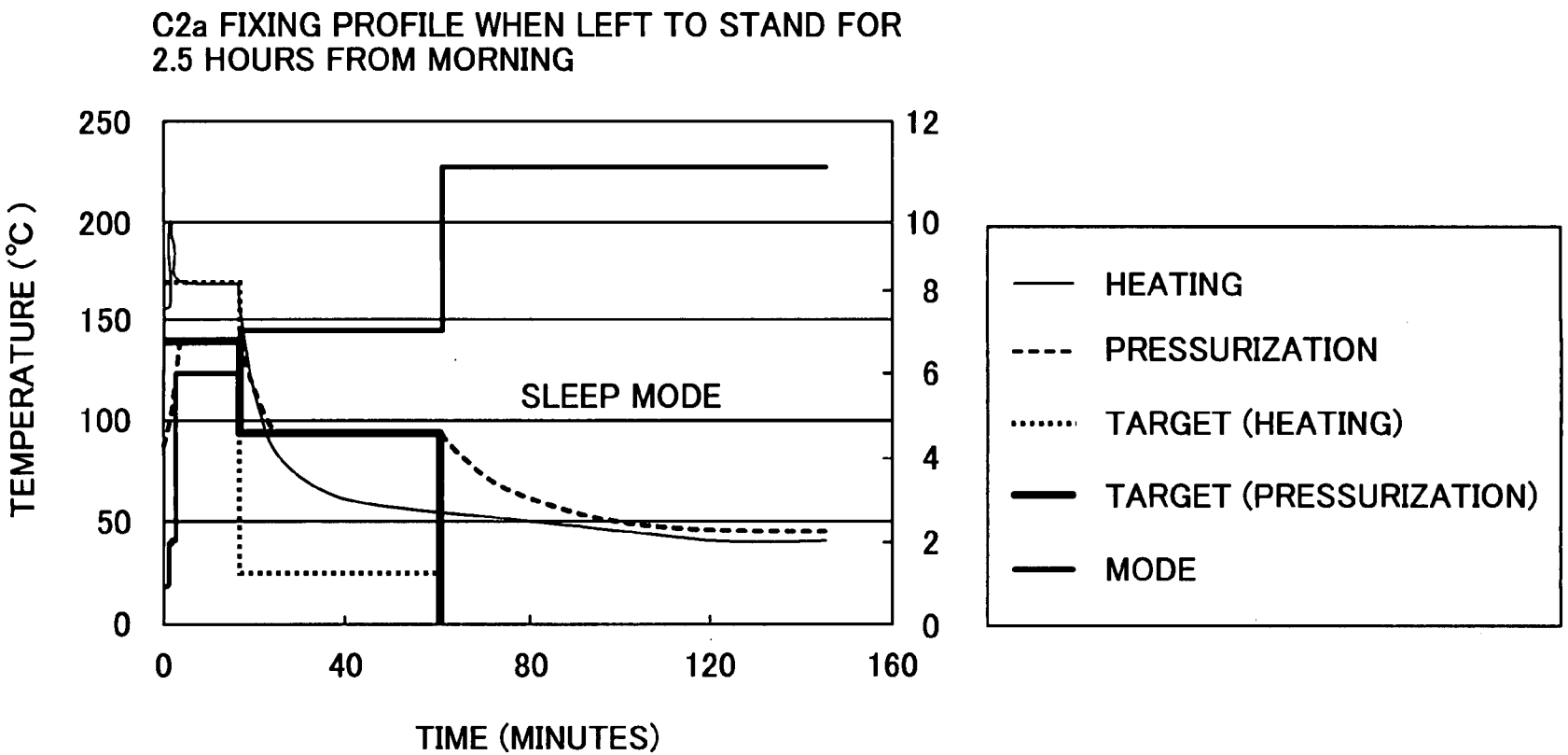
FIG. 13 is a view showing the change with time of temperature and pressure conditions of the fixing device when this image forming device is left to stand for 2.5 H from early morning.
Figure 14:
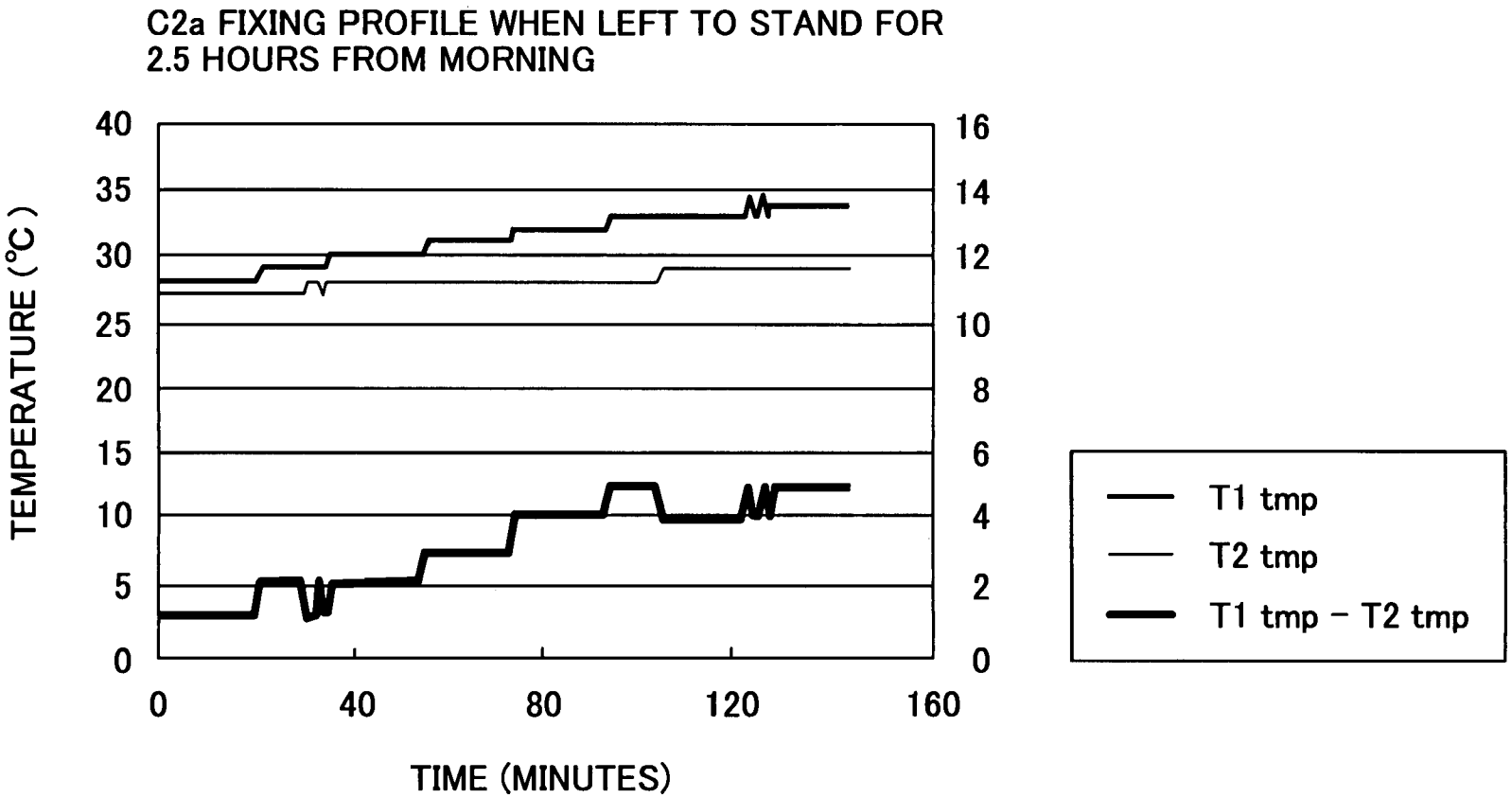
FIG. 14 is a view showing the change with time of the output value of the temperature sensor when this image forming device is left to stand for 2.5 H from early morning.

In view of design concepts regarding energy saving in recent years, when the device is not used (left to stand), after a certain time, the device shifts from low power mode (=in the case of the device of this embodiment, the temperature of the pressurizing roller, which is of large heat capacity, is lowered by about 40° C. from the normal standby temperature), and on being left to stand even further, to sleep mode (mode in which the fixing heater is OFF, but the CPU is live). In this case, as shown in the FIGS. 13 and 14, the temperature detection means S5 is put in a high temperature condition and the temperature detection means S6 is put in a low temperature condition, in other words a condition in which correction is implemented. However, in regard to fixing, the fixing device is cold, so correction is undesirable. That is, it has been found that, in cases where temperature correction of the fixing unit is turned ON before the device has warmed up, not merely without detecting the temperature of the member surface but also without detecting the temperature of items such as the metal core, poor fixing is produced. This is because the temperature of the temperature detection means S5 becomes high due to time overshoot of the standing time to a certain extent. In view of this drawback, in practical example 5 of this embodiment, an exclusion time is provided.

Figure 9:
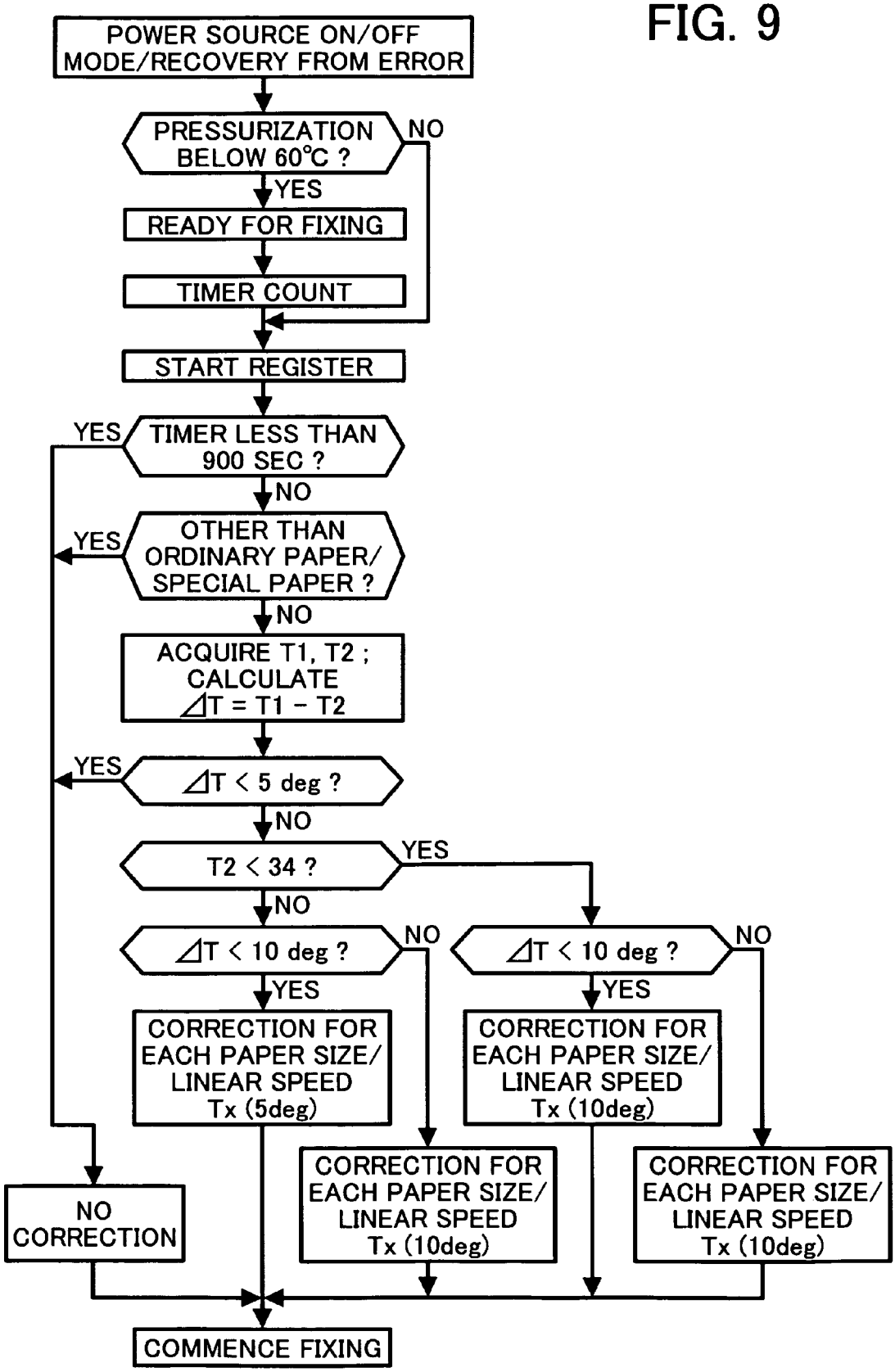
FIG. 9 is a control flowchart from turning ON of the power source up to the start of fixing, in an image forming device according to a second embodiment of the present invention.

In practical example 6 of this embodiment, in addition to practical example 5 described above, warm-up control is performed during turning ON of the power source, in the case of running out of toner or error recovery such as jam recovery, or in the case of recovery from low power mode; in this case, the pressurizing roller temperature is detected, and the fixing condition is evaluated in terms of a threshold value, as a result of which a decision is made to shift, or not to shift, to correction decision control (item "pressurization at 60° C." in the flowchart of FIG. 9). When the fixing unit as a whole is in a low temperature condition, the fixing performance is insufficient, so a recovery time from the cold condition is necessary until the fixing unit as a whole can warm up and so achieve sufficient fixing performance. Thus, accurate correction can be achieved by providing an exclusion time in which the aforesaid temperature correction is not performed for a certain prescribed time and in this way stable images can be provided.

In practical example 7 of this embodiment, the threshold value of correction and the exclusion time are changed in accordance with the temperature on switching on of the power source, so more accurate correction can be performed, making possible the provision of more stable images.

In practical example 8 of this embodiment, a belt fixing system is adopted, so the start-up time can be shortened. As described above, with this second embodiment, by comparing the temperatures detected by a plurality of sensors in the image forming device, the target control temperature is corrected in accordance with the result thereof. By correcting the target control temperature using the difference temperature of a plurality of sensors, rise in temperature within the image forming device can thereby be detected and the increase in amount of heat when the target fixing device as a whole or the image forming device as a whole has warmed up can be estimated, making possible optimal temperature correction.

Also, by taking into account the humidity of the outside air, temperature correction can be achieved taking into account the influence of the moisture content, which affects fixing. By combining the present invention with fixing using a belt of low thermal capacity, stable fixing can be achieved together with energy saving.

Third Embodiment

Figure 15:
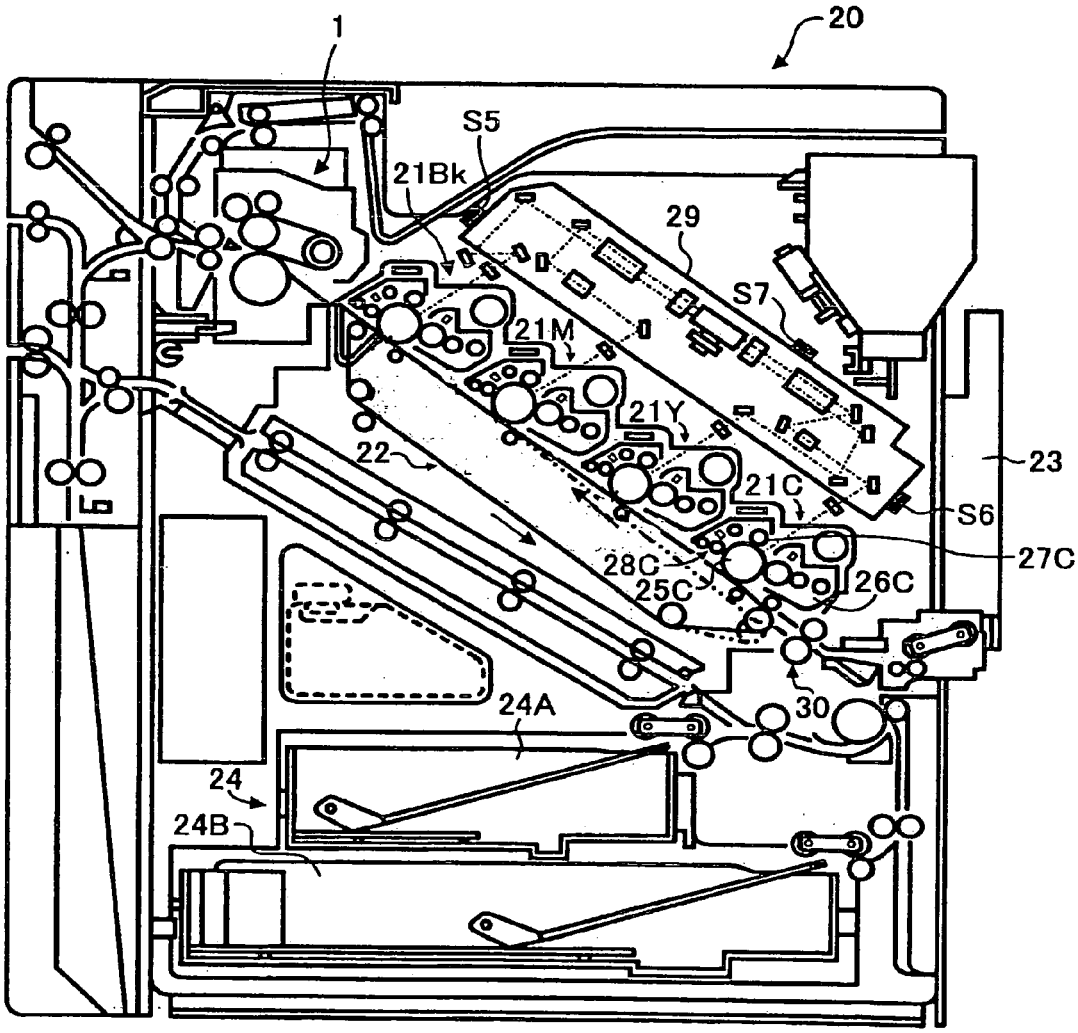
FIG. 15 is a view showing the construction of an image forming device comprising a fixing device according to a third embodiment of the present invention.

The construction of an image forming device according to this embodiment is shown in FIG. 15. However, since this is substantially the same as the construction of an image forming device according to the first embodiment shown in FIG. 1, repeated description is dispensed with and only the points of difference are described. Also, the fixing device according to this embodiment is substantially the same as the fixing device 1 of the first embodiment described above illustrated in FIG. 2, so repeated description is dispensed with and only the points of difference are described.

In the case of the image forming device of this embodiment, just as in the case of the image forming device of the second embodiment illustrated in FIG. 8, temperature sensors S5 and S6 are provided but, in addition, a humidity sensor S7 is provided. It should be noted that the temperature sensor S5 is provided with the object of measuring rise in temperature of the interior of the image forming device and, in the case of the present embodiment, is arranged on a side face on the fixing side of the writing device 29, but it could also be provided in a suitable position close to the fixing device 1, which is the main cause of rise of temperature. Also, the temperature sensor S6 is provided in the vicinity of the outer wall of the image forming device 20, where it is little influenced by rise in temperature of the interior of the image forming device.

In this embodiment, the belt and pressurizing roller within the fixing device 1 are respectively heated by a heating roller heater 6 and pressurizing roller heater 7, heating being conducted under control exercised by a fixing belt temperature sensor 13 and pressurizing roller temperature sensor 14 with which these are respectively provided so that the desired target control temperature is maintained. This image forming device has two modes, namely 600 dpi and 1200 dpi in regard to resolution of the printed image and also has, respectively for each of these, a monochromatic black mode and full-color mode, making a total of four modes. The target control temperature of the fixing device can be set at will when a printing request arrives at the control unit such that optimum images are obtained for the mode specified by the printing request. For example, the target control temperature of the belt is controlled to 170° C. in the case of a printing request for monochromatic black of 600 dpi and is controlled to 155° C. in the case of a printing request for full-color of 600 dpi. Also, the target control temperature in the case of the pressurizing roller is set lower by 15° C. to 30° C. than the target control temperature in the case of the belt.

FIG. 3 shows the action of the control unit. As shown in this Figure, at the time point where a printing request is made, the present control is performed by returning to the control unit the output value of the humidity sensor S7, in addition to that of the temperature sensors S5 and S6 and delivering to the drive unit a target control temperature determined in accordance with these output values.

Figure 17:
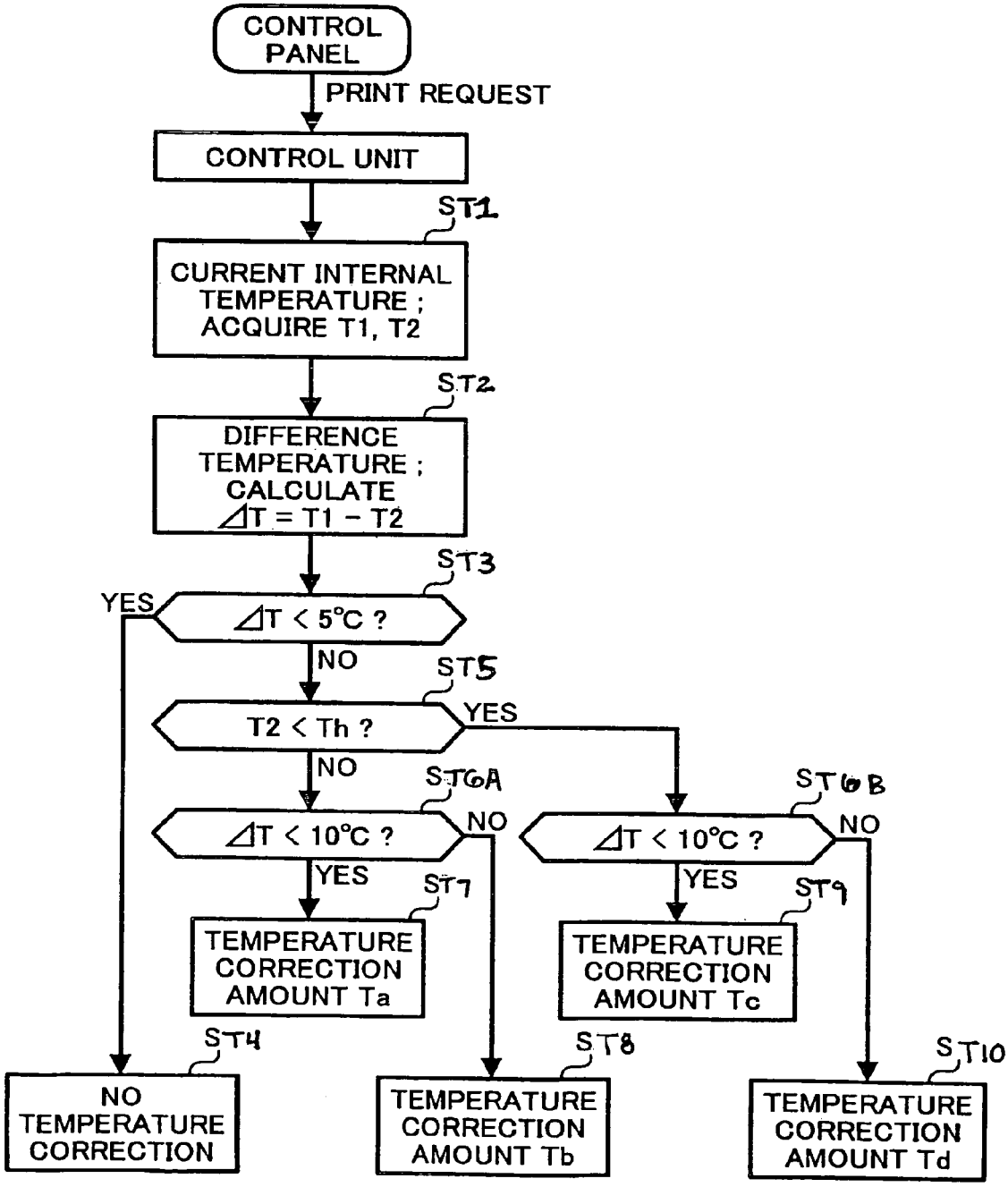
FIG. 17 is a flow chart showing the flow from the sending of a print request to the control unit up to commencement of fixing.

FIG. 17 is a flow chart showing the flow from delivery of a printing request to the control unit as far as commencement of fixing. An example of temperature correction control in the case where a printing request for monochromatic black 600 dpi arrives is described below. In the case of other modes also, a decision is made in the same way as to whether or not to perform temperature correction, and control is performed with a temperature correction amount that is correspondingly set.

When a printing request arrives at the control unit, the output values T1, T2 of the temperature sensors 31, 32 at this point are acquired (step ST1). Next, the difference ΔT of the previously acquired temperatures T1, T2 i.e. ΔT=T1-T2 is acquired (step ST2). Next, the magnitude relationship of the temperature ΔT and a threshold value temperature (taken as 5° C. in this embodiment) that can be arbitrarily set is compared (step ST3). If ΔT<5° C., it is concluded that temperature correction is not required since the interior of the image forming device has not heated up, and fixing is commenced with the target control temperature left at T=170° C. (step ST4). If ΔT≧5° C., T2 is compared with a threshold value Th that can be pre-set to an arbitrary value (step ST5) . The correction amount to be applied to the target control temperature is altered in accordance with the results of this comparative evaluation.

T2 is arranged on the outside air side of the image forming device so that a temperature which is substantially that of the outside air can be take into account. Thus, if T2 is higher than Th (34° C. in the case of this embodiment), it is considered that the transfer paper must be sufficiently warm, so a considerable reduction in the fixing temperature is necessary; and if T2 is lower than Th, it is considered that there is no need to apply much correction to the target control temperature.

Next, the magnitude relationship of the temperature of ΔT (assumed to be 10° C. in the case of this embodiment) and a threshold temperature that can be arbitrarily set is compared (step ST6A or ST6B). If T2<Th and ΔT<10° C., temperature correction is performed with a correction amount Ta (step ST7); if T2<Th and ΔT>10° C., correction is performed with a correction amount Tb (step ST8); if T2>Th and ΔT<10° C., temperature correction is performed with a correction amount Tc (step ST9); and if T2>Th and ΔT>10° C., correction is performed with a correction amount Td (step ST10). For example if T2<Th and ΔT<10° C., fixing is commenced after altering the target temperature control to 170° C.−Ta. This evaluation is repeated when a printing request is terminated or when the next printing request arrives. In this way, it is possible to set the optimum amount of heat for fixing taking into account the rise in temperature within the image forming device at the time point where the printing request arrives.

As mentioned above, the target control temperature of the fixing device is different for each of the various print request modes (for example, monochromatic, full-color, 600 dpi, 1200 dpi), so the temperature correction amounts referred to above may also be individually set.

In step ST2 of FIG. 17, in this embodiment, the difference temperature ΔT was found and was employed for the threshold value for execution/non-execution of temperature correction. However, a value obtained by dividing this difference temperature ΔT by the lapsed time until a printer request arrives after turning the power source ON could also be used as a threshold value. Also, if the value T2 of the temperature sensor S6 at the time point where the power source is turned ON is stored in the control unit, a value obtained by subtracting T2 from the output value T1 of the temperature sensor S5 when a printing request is made could be used for the difference temperature. Since the temperature sensor S6 is mounted in the vicinity of the outer wall of the image forming device, there is a possibility of elevation of temperature due to thermal conduction such as heat transfer or convection, giving rise to the possibility of deviation between the outside air temperature and the output value of the temperature sensor S6. For this reason, the value obtained when the power source is turned ON, which is unlikely to be influenced by the above, is used for control purposes.

Figure 16:
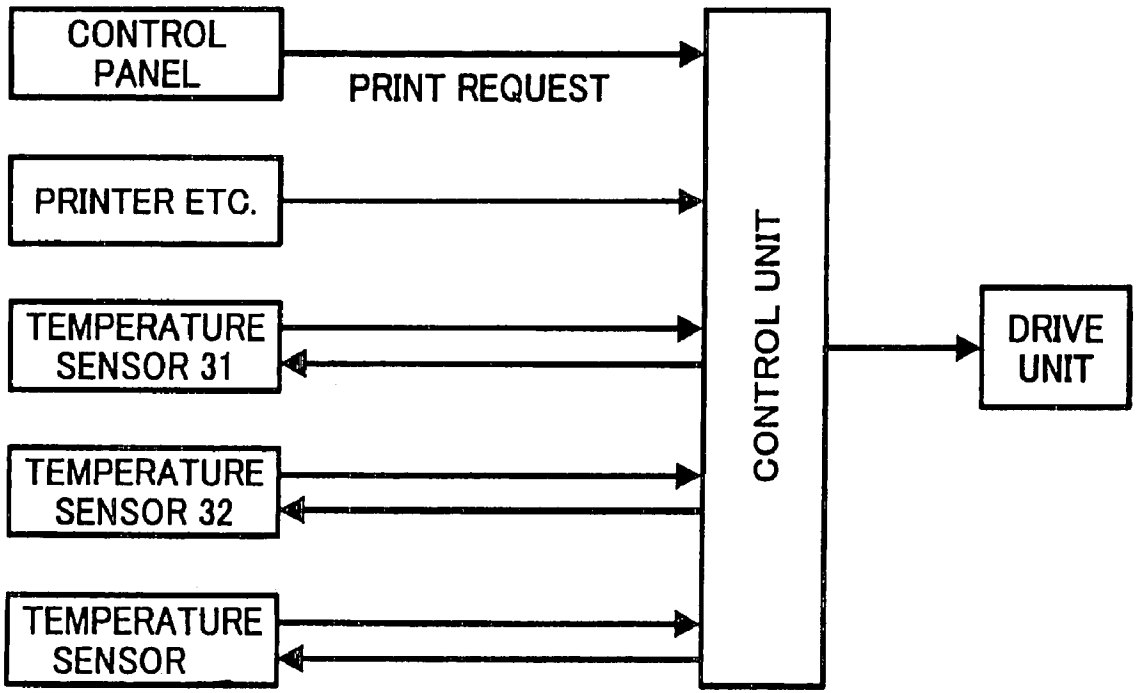
FIG. 16 is a view showing the action of the control unit of this image forming device.

It should be noted that, although not discussed in the embodiments, by using the humidity sensor S7, a temperature correction value can be employed which is altered in accordance with the humidity of the outside air or in the image forming device, which considerably affects the water content of the transfer paper. In this case, as shown in FIG. 16, the present control can be performed by returning to the control section the output value of the humidity sensor. S7 in addition to that of the temperature sensors S5 and S6 at the time point where there is a printing request, and passing the target control temperature, which is determined in accordance with these output values, to the drive unit.

Figure 18:
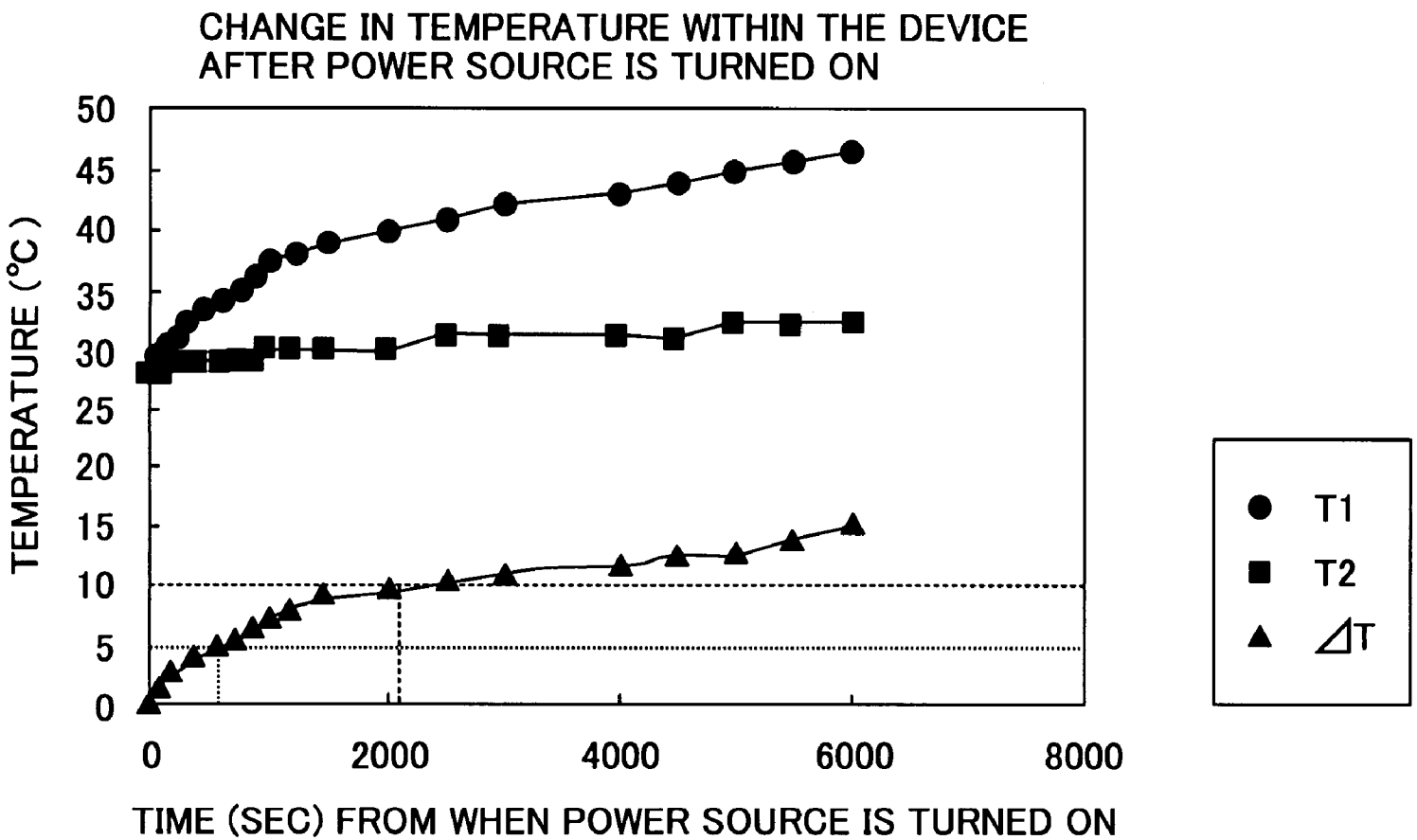
FIG. 18 is a view showing a graph of the change with time of temperature within the device from turning ON of the power source, in this image forming device.

FIG. 18 is a graph showing the change in temperature within the device against lapsed time after the power source is turned ON. With lapse of time after the power source is turned ON, the temperature of the temperature sensor SS that is nearest the fixing device 1 rises. In contrast, the temperature of the temperature sensor S6 that is near to the external wall does not rise very much, so the difference ΔT thereof increases. In this embodiment, the threshold values for execution/non-execution of temperature correction were taken as ΔT=5° C. and ΔT=10° C., but desired threshold values can be set depending on the construction of the image forming device 20 and the position of the temperature sensors.

As described above, in this embodiment, an image forming device can be provided whereby stable fixing performance is obtained and wherein excellent fixing properties are achieved and curling of the paper after fixing does not occur, by performing control in which fixing temperature correction is performed by environmental sensing over time, in addition to during standby.

Various modifications will become possible for those skilled in the art after receiving the teachings of the present disclosure without departing from the scope thereof.

What is claimed is:

1. An image forming device comprising:

a fixing device to fix a transfer member that carries a toner image that is not yet fixed;

a temperature detection device to detect a temperature within the image forming device in which the fixing device is provided; and a control device to correct a control temperature of the fixing device for a first time period using only the detection result of the temperature detection device, the temperature detection device being arranged in the vicinity of the fixing device.

2. The image forming device as claimed in claim 1, further comprising:

a second temperature detection devices to detect a second temperature within the image forming apparatus in which the fixing device is provided, wherein the control device is further configured to correct the control temperature of the fixing device in accordance with the second temperature for a second time period.

3. The image forming device as claimed in claim 1 wherein the fixing device is a fixing device employing at least one endless belt.

4. An image forming device comprising:

a fixing device to perform fixing by heating a transfer member that carries a toner image that is not yet fixed;

a temperature detection device to detect a temperature within the image forming device in which the fixing device is provided; and a control device to correct a control temperature of the fixing device for a first time period using only the detection result of the temperature detection device, wherein the temperature detection device is useable to detect a temperature of a cover of the fixing device.

5. The image forming device as claimed in claim 4, further comprising:

a second temperature detection device to detect a second temperature within the image forming apparatus in which the fixing device is provided, wherein the control device is further configured to correct the control temperature of the fixing device in accordance with the second temperature for a second time period.

6. The image forming device as claimed in claim 4 wherein the fixing device is a fixing device employing at least one endless belt.

7. An image forming device comprising:

a fixing device that performs fixing by heating a transfer member that carries a toner image that is not yet fixed;

a temperature detection device to detect a temperature within the image forming device in which the fixing device is provided; and a control device to correct a control temperature of the fixing device for a first time period using only the detection result of the temperature detection device, wherein the temperature detection device is usable to detect a temperature of a feed guide plate arranged between a transfer nip and a fixing nip.

8. The image forming device as claimed in claim 7, further comprising:

a second temperature detection device to detect a second temperature within the image forming apparatus in which the fixing device is provided, wherein the control device is further configured to correct the control temperature of the fixing device in accordance with the second temperature for a second time period.

9. The image forming device as claimed in claim 7 wherein the fixing device is a fixing device employing at least one endless belt.

10. An image forming device comprising:

a fixing device that performs fixing by heating a transfer member that carries a toner image that is not yet fixed;

a temperature detection device to detect a temperature within the image forming device in which the fixing device is provided; and a control device to correct a control temperature of the fixing device for a first time period using only the detection result of the temperature detection device, wherein the temperature detection device is usable to detect a temperature of a transfer belt.

11. The image forming device as claimed in claim 10, further comprising:

a second temperature detection device to detect a second temperature within the image forming apparatus in which the fixing device is provided, wherein the control device is further configured to correct the control temperature of the fixing device in accordance with the second temperature for a second time period.

12. The image forming device as claimed in claim 10 wherein the fixing device is a fixing device employing at least one endless belt.

13. An image forming device comprising:

a fixing device to fix a transfer member that carries a toner image that is not yet fixed;

a first temperature detection device to detect a first temperature within the image forming device in which the fixing device is provided;

a second temperature detection device to detect a second temperature within the image forming device in which the fixing device is provided; and a control device to correct a control temperature of the fixing device for a first time period in accordance with the first temperature and a second time period in accordance with the second temperature.

14. The image forming device of claim 13, wherein the first temperature detection device is arranged in the vicinity of the fixing device.

15. The image forming device of claim 13, wherein the first temperature detection device is usable to detect a temperature of a cover of the fixing device.

16. The image forming device of claim 15, wherein the second temperature detection device is usable to detect a temperature of a feed guide plate.

17. The image forming device of claim 15, wherein the second temperature detection device is usable to detect a temperature of a transfer belt.

18. The image forming device of claim 13, further comprising:

a third temperature detection device to detect a third temperature within the image forming device in which the fixing device is provided, wherein the control device is further configured to correct the control temperature of the fixing device for the second time period in accordance with either the second or the third temperatures.

19. The image forming device of claim 18, wherein the first temperature detection device is usable to detect a temperature of a cover of the fixing device, the second temperature detection device is usable to detect a temperature of a guide plate, the third temperature detection device is usable to detect the temperature of a transfer belt.

* * * * *